US010183390B2

(12) United States Patent
Wiedemann et al.

(10) Patent No.: US 10,183,390 B2
(45) Date of Patent: Jan. 22, 2019

(54) DRILL HAMMER AND/OR CHIPPING HAMMER DEVICE

(75) Inventors: Christian Wiedemann, Wiernsheim (DE); Achim Duesselberg, Kirchheim Unter Teck (DE)

(73) Assignee: Robert Bosch GmbH, Stuttgart (DE)

( * ) Notice: Subject to any disclaimer, the term of this patent is extended or adjusted under 35 U.S.C. 154(b) by 2076 days.

(21) Appl. No.: 13/393,378

(22) PCT Filed: Jul. 16, 2010

(86) PCT No.: PCT/EP2010/060318

§ 371 (c)(1),
(2), (4) Date: Apr. 11, 2012

(87) PCT Pub. No.: WO2011/026683

PCT Pub. Date: Mar. 10, 2011

(65) Prior Publication Data

US 2012/0186842 A1 Jul. 26, 2012

(30) Foreign Application Priority Data

Sep. 1, 2009 (DE) ..... 10 2009 029 055

(51) Int. Cl.

| | |
|---|---|
| ***B25D 11/00*** | (2006.01) |
| ***B25D 11/12*** | (2006.01) |
| ***B25D 16/00*** | (2006.01) |

(52) U.S. Cl.

CPC ..... *B25D 11/125* (2013.01); *B25D 16/003* (2013.01); *B25D 2211/003* (2013.01); *B25D 2250/165* (2013.01)

(58) Field of Classification Search

CPC ..... B25D 16/003; B25D 17/06; B25D 17/24; B25D 11/125; B25D 2216/0023;

(Continued)

(56) References Cited

U.S. PATENT DOCUMENTS 2,342,540 A * 2/1944 Hale ..... 464/35
3,022,683 A * 2/1962 Simon ..... F16H 3/666 475/276

(Continued)

FOREIGN PATENT DOCUMENTS

CN 1332062 A 1/2002
CN 1333100 A 1/2002

(Continued)

OTHER PUBLICATIONS

EPO translation of EP1172180A2, Translation was retrieved on Apr. 29, 2015, 12 pages.*

(Continued)

*Primary Examiner* — Hemant M Desai
*Assistant Examiner* — Eyamindae Jallow
(74) *Attorney, Agent, or Firm* — Maginot, Moore & Beck LLP

(57) ABSTRACT

A drill hammer and/or a chipper hammer device includes a hammer mechanism having a drive unit and a transmission unit. The transmission unit transmits a drive torque from a motor to the hammer mechanism. The transmission unit includes at least one planetary drive. A drive element of the drive unit is disposed on a transmission element of the planetary drive.

20 Claims, 6 Drawing Sheets

(58) Field of Classification Search
CPC ..... B25D 2250/165; F16D 2023/123; F16D 7/10; B25B 23/141; B25B 21/026
USPC ..... 173/47, 48, 13, 14, 90, 216; 192/44, 192/45.004, 56.1; 464/35
See application file for complete search history.

(56) References Cited

U.S. PATENT DOCUMENTS 4,034,833 A * 7/1977 Jeter ..... 192/45.004
4,041,729 A * 8/1977 Bilz ..... 192/56.5
4,460,078 A * 7/1984 Heide et al. ..... 192/56.5
4,579,019 A * 4/1986 Gabriele ..... F16H 3/66 475/47
5,295,925 A * 3/1994 Hirabayashi ..... F16H 1/2836 475/331
5,480,362 A * 1/1996 Tanaka ..... F16H 57/0479 475/325
6,223,833 B1 * 5/2001 Thurler ..... B25D 16/00 173/109
6,733,414 B2 * 5/2004 Elger ..... 475/331
7,037,200 B2 * 5/2006 Dorrie et al. ..... 464/35
7,059,425 B2 * 6/2006 Ikuta ..... B25D 11/005 173/117
7,395,876 B1 * 7/2008 Walker ..... B25B 21/00 173/164
7,407,460 B2 * 8/2008 Eisenhardt ..... 475/303
7,537,540 B2 * 5/2009 Baumann et al. ..... 475/263
7,794,355 B2 * 9/2010 Pusateri ..... 475/331
8,235,137 B2 * 8/2012 Walker ..... B25B 21/00 173/216
2004/0226969 A1 * 11/2004 Shew ..... F16N 3/12 222/333
2006/0000624 A1 * 1/2006 Hara ..... B25B 23/141 173/48
2006/0048958 A1 * 3/2006 Ikuta ..... B25D 11/005 173/201
2006/0086514 A1 * 4/2006 Aeberhard ..... B25B 21/00 173/48
2006/0162945 A1 * 7/2006 Soderlund ..... B25F 5/001 173/216
2006/0237205 A1 * 10/2006 Sia ..... B25B 21/00 173/48
2006/0243468 A1 * 11/2006 Meixner ..... B25D 11/005 173/48
2006/0289182 A1 * 12/2006 Tsai ..... B25D 16/006 173/48
2007/0114050 A1 * 5/2007 Baumann ..... B23B 45/008 173/216
2008/0173459 A1 * 7/2008 Kuroyanagi ..... B25F 5/001 173/216
2010/0224033 A1 * 9/2010 Yeoh ..... B25B 21/02 81/57.11
2012/0305359 A1 * 12/2012 Sato et al. ..... 192/45.001

FOREIGN PATENT DOCUMENTS

CN 1367067 A 9/2002
CN 1761553 A 4/2006
CN 201053482 Y 4/2008
DE 101 03 141 A1 7/2002
DE 103 30 180 A1 1/2005
DE 10 2006 020 172 A1 11/2007
EP 0 200 844 A1 11/1986
EP 1 172 180 A2 1/2002
EP 1 174 213 A1 1/2002
RU 2 099 174 C1 12/1997

OTHER PUBLICATIONS

International Search Report corresponding to PCT Application No. PCT/EP2010/060318, dated Nov. 10, 2010 (German and English language document) (5 pages).

* cited by examiner

DRILL HAMMER AND/OR CHIPPING HAMMER DEVICE

This application is a 35 U.S.C. § 371 National Stage Application of PCT/EP2010/060318, filed on Jul. 16, 2010, which claims the benefit of priority to Serial No. DE 10 2009 029 055.9, filed on Sep. 1, 2009 in Germany, the disclosures of which are incorporated herein by reference in their entirety.

BACKGROUND

A drill hammer and chipping hammer device with a hammer percussion mechanism and with a gear unit for transmitting a drive torque from an electric motor to the hammer percussion mechanism is known. The gear unit has in this case spur wheels which are in engagement with one another.

SUMMARY

A drill hammer and/or chipping hammer device with a hammer percussion mechanism which has a drive unit, and with a gear unit for transmitting a drive torque from a motor to the hammer percussion mechanism, the gear unit comprising at least one planetary gear, and a drive element of the drive unit being arranged on a gear element of the planetary gear, is proposed. In this context, a "hammer percussion mechanism" is to be understood, in particular, to mean a percussion mechanism with a beater which can be accelerated over a travel in the beating direction before it impinges onto a component in order to trigger a beating pulse, such as, preferably, a pneumatic percussion mechanism in which a beater can be driven by a piston via a gas cushion, or a mechanical percussion mechanism in which a beater can be accelerated by a mechanical arrangement, such as, in particular, a spring arm. A "planetary gear" is to be understood, in particular, to mean a gear which has at least one planet which is connected to a planet carrier and which is coupled outwardly in the radial direction to a ring wheel and/or inwardly in the radial direction to a sun wheel and therefore has, in particular, a plurality of coaxial shafts. The sun wheel, the planet and/or the ring wheel may be formed by round gear wheels or by mutually coordinated nonround gear wheels. A plurality of planetary gears may be connected one behind the other and/or a plurality of steps may be interposed between planet wheel and ring wheel. The drive unit may be formed by various units which seem expedient to a person skilled in the art, such as by a wobble bearing unit in which a wobble element is mounted in a bearing plane which is tilted to an axis of rotation by an angle greater than zero, such as, in particular, in a bearing plane spanned by a rolling body raceway, a drive unit formed by a cam track unit and/or, especially advantageously, by an eccentric unit which has, in particular, an eccentrically arranged drive element, such as, in particular, an eccentrically arranged drive bolt. An especially simple and robust construction can be achieved by means of an eccentric unit. The drive unit serves particularly for converting a rotational movement into an axial beating movement. Furthermore, "arranged on a gear element" is to be understood in this context to mean, in particular, that the drive element, such as, in particular, a bearing element with a tilted bearing track of a wobble bearing unit or, especially advantageously, an eccentric bolt of an eccentric unit, is connected fixedly to a gear element of the planetary gear, such as, in particular, to a ring wheel, a planet carrier and/or to a planet of the planetary gear.

By means of a corresponding configuration, an advantageous step-up can be achieved by means of an especially space-saving construction, specifically, in particular, when the planetary gear has an input element, such as, in particular, a sun wheel, the axis of rotation of which is arranged at least essentially coaxially to an axis of rotation of a drive element of the hammer percussion mechanism. The term "essentially coaxially" is to be understood, in particular, to mean that the shafts form an angle of less than 30° and preferably of less than 10°. In this case, an "input element" is to be understood, in particular, to mean an element, via which a torque is introduced into the gear unit and the axis of rotation of which is arranged, in particular, coaxially to an axis of rotation of the motor. Furthermore, as a result of the structural configuration, the gear unit can advantageously be designed as a premountable subassembly, and a small load upon a motor shaft can be achieved, and the motor shaft can be designed with a smaller diameter, with the result that the motor can also be made smaller.

In a further refinement of the disclosure, it is proposed that an axis of rotation of the planetary gear and a beating axis of the hammer percussion mechanism form an angle unequal to zero, that is to say have an orientation deviating from a parallel or coaxial orientation, as a result of which, in particular, even larger motors can advantageously be integrated, specifically, in particular, when the axis of rotation of the planetary gear and the beating axis of the hammer percussion mechanism, in which a beating pulse is transmitted during operation, form an angle greater than 10° and preferably greater than 20°. Especially advantageously, an L form of construction can be achieved, in which the axis of rotation of the planetary gear and the beating axis of the hammer percussion mechanism form at least essentially, that is to say with a deviation of less than 10° and preferably of less than 5°, an angle of 90°.

If at least one gear element of the planetary gear is formed in one piece with a drive element of the hammer percussion mechanism, such as, in particular, with an eccentric element and/or a wobble bearing element, additional components, construction space, weight, outlay in assembly terms and costs can be saved. In this context, "in one piece" is to be understood, in particular, to mean produced in one casting. Basically, however, a multipart form may also be envisaged, in which parts are connected by means of a riveted, welded and/or brazed joint, etc.

In a further refinement of the disclosure, it is proposed that the drill hammer and/or chipping hammer device has at least one lockup clutch, with the result that undesirably high torques can advantageously be avoided.

Furthermore, it is proposed that the lockup clutch be arranged in the force flux between a planet carrier and an element of the gear unit and/or between a ring wheel and an element of the gear unit, with the result that the lockup clutch can advantageously be integrated simply and in a space-saving way.

In a further refinement of the disclosure, it is proposed that a ring wheel and a planet carrier of the planetary gear are connected via a bearing connection, that is to say, in particular, at least one ring wheel is mounted via a planet carrier, so that bearing forces of the ring wheel are supported via the planet carrier, and/or at least one planet carrier is mounted via a ring wheel, so that bearing forces of the planet carrier are supported via the ring wheel. By virtue of a corresponding configuration, construction space can advantageously be saved.

In a further refinement of the invention, it is proposed that a ring wheel and a planet carrier of the planetary gear are connected via a bearing connection, that is to say, in particular, at least one ring wheel is mounted via a planet carrier, so that bearing forces of the ring wheel are supported via the planet carrier, and/or at least one planet carrier is mounted via a ring wheel, so that bearing forces of the planet carrier are supported via the ring wheel. By virtue of a corresponding configuration, construction space can advantageously be saved.

Furthermore, it is proposed that the gear element of the planetary gear on which the drive element is arranged be driven, in at least one operating mode, with a superposed rotational movement, so that the drive element executes a linear movement along a beating axis of the hammer percussion mechanism. As a result of a corresponding configuration, components, such as, in particular, pivotably mounted connecting rod elements, weight, construction space and costs can be saved. In particular, the drive element can advantageously be connected directly to a piston of the hammer percussion mechanism. In this case, various gear elements of the planetary gear which seem to be expedient to a person skilled in the art may be acted upon with a superposed rotational movement, but a corresponding configuration can be achieved especially advantageously in a simple way when the gear element is formed by a planet and the drive element of the drive unit is arranged on a planet of the planetary gear.

BRIEF DESCRIPTION OF THE DRAWINGS

Further advantages may be gathered from the following drawing description. The drawing illustrates exemplary embodiments of the disclosure. The drawing, description and claims contain numerous features in combination. A person skilled in the art will expediently also consider the features individually and combine them into appropriate further combinations.

In the drawing.

DETAILED DESCRIPTION

Figure 1:
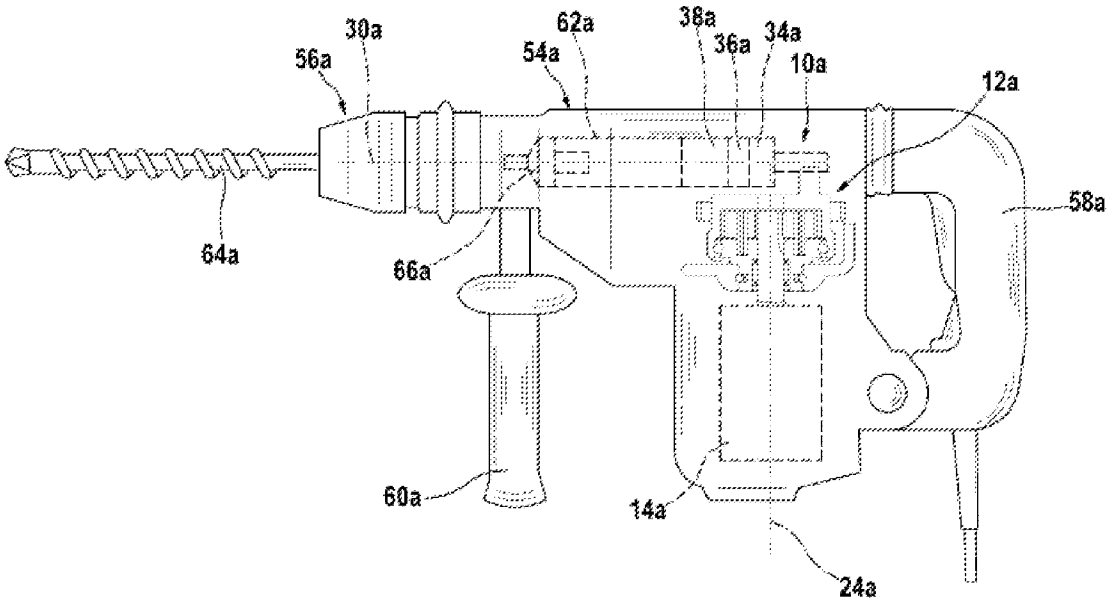
FIG. 1 shows a drill hammer and chipping hammer in a side view with a drill hammer and chipping hammer device indicated diagrammatically.
Figure 2:
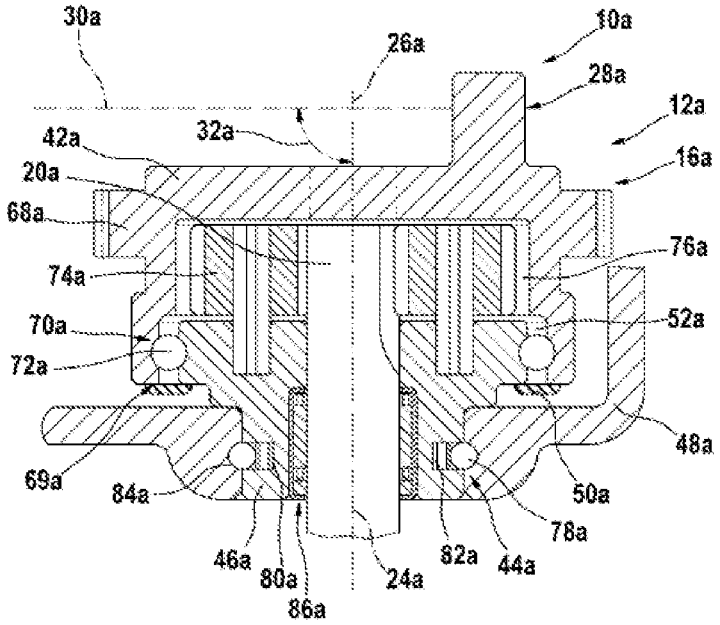
FIG. 2 shows a detail of the diagrammatically illustrated drill hammer and chipping hammer device from FIG. 1.

FIG. 1 shows a drill hammer and chipping hammer with a drill hammer and chipping hammer device arranged in a housing 54*a*. A main handle 58*a* formed by a bow-type handle is fastened to the housing 54*a* on a side facing away from a toolholder 56*a* and an additional handle 60*a* formed by a post-type handle is fastened to the housing 54*a* on a side facing the toolholder 56*a*. The drill hammer and chipping hammer device has a hammer percussion mechanism 10*a* which comprises a hammer tube 62*a*, a piston 34*a* guided in the hammer tube 62*a* and a beater 38*a* drivable by the piston via a gas cushion 36*a* and which acts during operation upon an insert tool 64*a* via a header 66*a*. Furthermore, the hammer percussion mechanism 10*a* comprises a drive unit with a drive element 28*a* which is formed by an eccentric element and which is intended for converting a rotational movement into an axial stroke movement and consequently for driving the piston 34*a* in the axial direction of the hammer tube 62*a* (FIGS. 1 and 2).

The drill hammer and chipping hammer device comprises a gear unit 12*a* for transmitting a drive torque from an electric motor 14*a* arranged in the housing 54*a* to the hammer percussion mechanism 10*a* or to the drive element 28*a*. The gear unit 12*a* has a planetary gear 16*a*. The planetary gear 16*a* has an input element 20*a* which is formed by a sun wheel and the axis of rotation 24*a* of which is arranged coaxially to an axis of rotation 26*a* of the drive element 28*a* of the hammer percussion mechanism 10*a*. The sun wheel is formed in one piece with a motor shaft of the electric motor 14*a*. The axis of rotation 24*a* of the planetary gear or of the sun wheel is arranged coaxially to an axis of rotation of the electric motor 14*a*. The axis of rotation 24*a* and a beating axis 30*a* of the hammer percussion mechanism 10*a* form an angle 32*a* of 90°. Basically, however, other angles may also be envisaged. A ring wheel 42*a* of the planetary gear 16*a* forms an output element of the gear unit 12*a*. The drive element 28*a* is arranged on the ring wheel 42*a*, specifically, the ring wheel 42*a* is formed in one piece with the drive element 28*a* (FIG. 2). Integrally formed on an outer circumference of the ring wheel 42*a* is a gear wheel 68*a* which is provided for transmitting a rotational movement from the ring wheel 42*a* to the hammer tube 62*a* during drilling operation. The ring wheel 42*a* is mounted rotatably on a planet carrier 46*a* of the planetary gear 16*a* by means of a bearing connection 69*a* formed by a rolling bearing 70*a*, the rolling surfaces of the rolling bearing 70*a* being integrally formed in one piece onto the planet carrier 46*a* and onto the ring wheel 42*a*, or the planet carrier 46*a* and the ring wheel 42*a* forming rolling surfaces for balls 72*a* of the rolling bearing 70*a*. Instead of balls, basically other rolling bodies which seem expedient to a person skilled in the art may also be envisaged. The planet carrier 46*a* carries a plurality of planets 74*a* which mesh inwardly in the radial direction with the sun wheel or the input element 20*a* of the planetary gear 16*a* and mesh outwardly in the radial direction with an internal toothing 76*a* of the ring wheel 42*a*. The planet carrier 46*a* is supported in a housing element 48*a* of the gear unit 12*a* via a lockup clutch 44*a* of the drill hammer and chipping hammer device. The lockup clutch 44*a* has lockup balls 78*a* which are mounted displaceably counter to an annular spring 82*a*, in radial recesses 80*a* of the planet carrier 46*a* and engage outwardly in the radial direction into a latching contour 84*a* which is integrally formed onto an inner circumference of the ring wheel 42*a*. If, during operation, a torque to be transmitted by the ring wheel 42*a* lies below a specific lockup torque, the planet carrier 46*a* is held fixedly in terms of rotation in the housing element 48*a* by means of the lockup clutch 44*a*, and a torque can be transmitted from the ring wheel 42*a* to the hammer percussion mechanism 10*a* and/or to the hammer tube 62*a*. If the lockup torque is reached, the lockup balls 78*a* are deflected inwardly in the radial direction counter to a spring force in the annular spring 82*a* and the planet carrier 46*a* rotates in the housing element 48*a*. Alternatively, however, the planet carrier 46*a* could also be formed in one piece with the housing element 48*a*.

In order to achieve advantageous lubrication, a planetary gear inner space 52*a* in which, in particular, the planets 74*a* are arranged is filled with lubricant. The planetary gear inner space 52*a* is sealed off by means of a sealed-off needle bearing 86*a* between the input element 20*a* and the planet carrier 46*a* and also by means of a sealing means 50*a* formed by a brushing seal. The annular sealing means 50*a* is fastened with its radially inner region to the planet carrier 46*a* and with its radially outer region lies, loaded by an internal tension force, on an end face of the ring wheel 42*a*.

Figure 3:
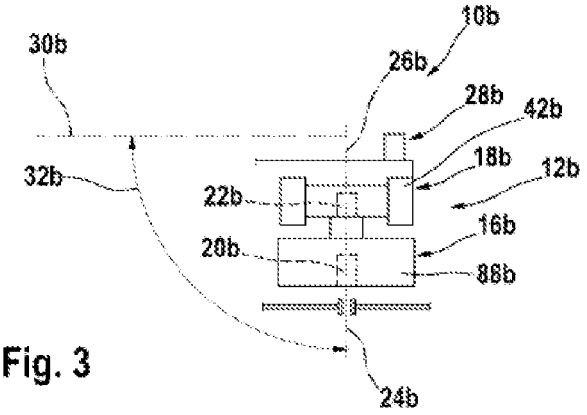
FIG. 3 shows a detail of an alternative diagrammatically illustrated drill hammer and chipping hammer device having two planetary gears connected in series.
Figure 4:
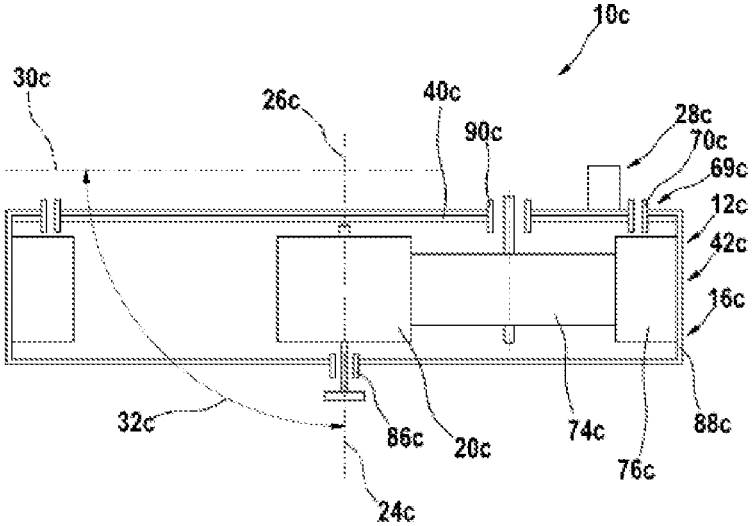
FIG. 4 shows a detail of an alternative diagrammatically illustrated drill hammer and chipping hammer device with an alternative output element.

FIGS. 3 and 4 show details of alternative exemplary embodiments. Components, features and functions which remain the same are basically numbered by the same reference symbols. To distinguish the exemplary embodiments, the letters a to c are added to the reference symbols. The following description is basically restricted to differences from the exemplary embodiment in FIGS. 1 and 2. As regards features and functions which remain the same, reference may be made to the description of the exemplary embodiment in FIGS. 1 and 2.

FIG. 2 illustrates a detail of an alternative diagrammatically illustrated drill hammer and chipping hammer device which has a gear unit 12*b* with two planetary gears 16*b*, 18*b* connected in series. The planetary gear 16*b* has an input element 20*b* coupled fixedly in terms of rotation to an electric motor, not illustrated in any more detail, and formed by a sun wheel, and a ring wheel 88*b*. The ring wheel 88*b* of the planetary gear 16*b* is coupled fixedly in terms of rotation to an input element 22*b* of the second planetary gear 18*b*. The input elements 20*b*, 22*b* have a common axis of rotation 24*b*. Furthermore, the second planetary gear 18*b* has a ring wheel 42*b* which forms an output element of the gear unit 12*b* and which is formed in one piece with a drive element 28*b* of a hammer percussion mechanism 10*b*.

FIG. 4 shows a drill hammer and chipping hammer device of a drill hammer and chipping hammer, with a gear unit 12*c* which has a planetary gear 16*c*. The planetary gear 16*c* has an input element 20*c* which is formed by a sun wheel and the axis of rotation 24*c* of which is arranged coaxially to an axis of rotation 26*c* of a drive unit or drive element 28*c* of the drive unit of a hammer percussion mechanism 10*c*. The sun wheel and a motor shaft in one piece with the sun wheel are mounted in a ring wheel 42*c* of the planetary gear 16*c* by means of a needle bearing 86*c*. Alternatively, the sun wheel and/or the motor shaft could be mounted in a planet carrier 40*c* of the planetary gear 16*c*. The planet carrier 40*c* of the planetary gear 16*c* forms an output element of the gear unit 12*c*. The drive element 28*c* is arranged on the planet carrier 40*c*, specifically, the planet carrier 40*c* is formed in one piece with the drive element 28*c*. To pick up a torque for driving a hammer tube in rotation, the planet carrier 40*c* could be connected to a gear wheel or a gear wheel could be integrally formed onto the planet carrier 40*c*. The planet carrier 40*c* is mounted rotatably in the ring wheel 42*c* of the planetary gear 16*c* by means of a bearing 70*c*. The planet carrier 40*c* carries a plurality of planets 74*c* which mesh inwardly in the radial direction with the sun wheel or the input element 20*c* of the planetary gear 16*c* and mesh outwardly in the radial direction with an internal toothing 76*c* of the ring wheel 42*c*. The planets 74*c* are in each case mounted fixedly in terms of rotation on axles which are mounted rotatably in the planet carrier 40*c* in each case via a bearing 90*c*. Alternatively, the planets 74*c* could also be mounted rotatably on the axles and the axles could be arranged fixedly in terms of rotation in the planet carrier 40*c*. The planetary gear 16*c* is filled with lubricant and the bearings 70*c*, 86*c*, 90*c* are sealed off. The ring wheel 42*c* is arranged fixedly in terms of rotation in a housing, not illustrated in any more detail, of a drill hammer and chipping hammer. In order to ensure a lockup function, the ring wheel 42*c* could be mounted in the housing of the drill hammer and chipping hammer via a lockup clutch, and/or a lockup clutch could be arranged between the planet carrier 40*c* and the hammer tube.

Figure 5:
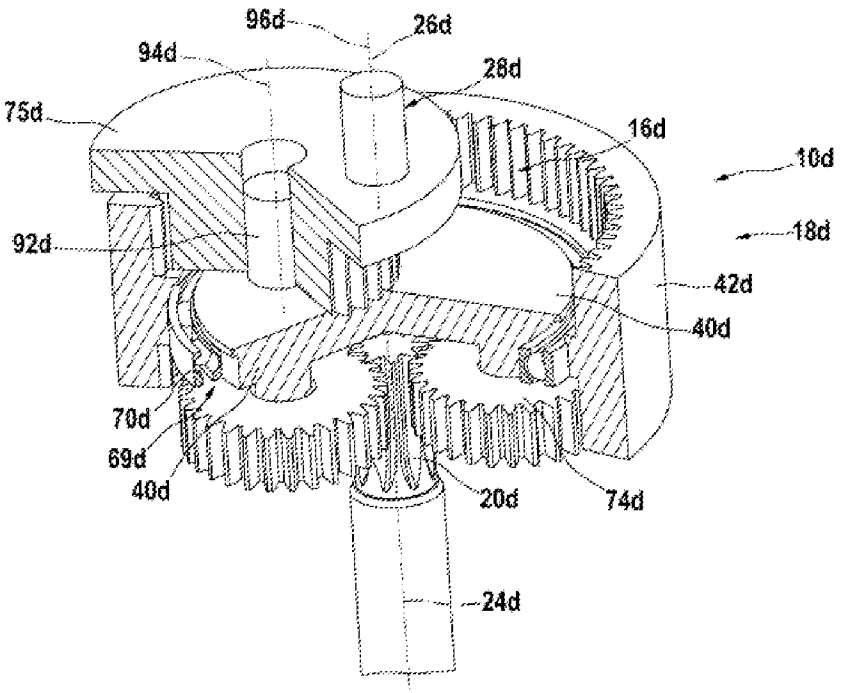
FIG. 5 shows a detail of a further alternative drill hammer and chipping hammer device in perspective illustration with part sections.
Figure 6:
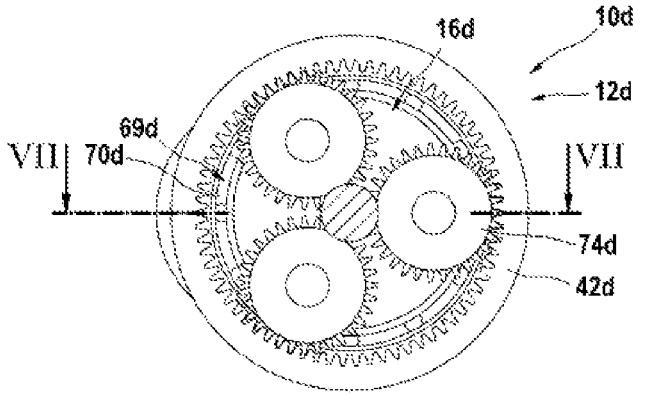
FIG. 6 shows a view of the drill hammer and chipping hammer device from FIG. 5 from below.
Figure 7:
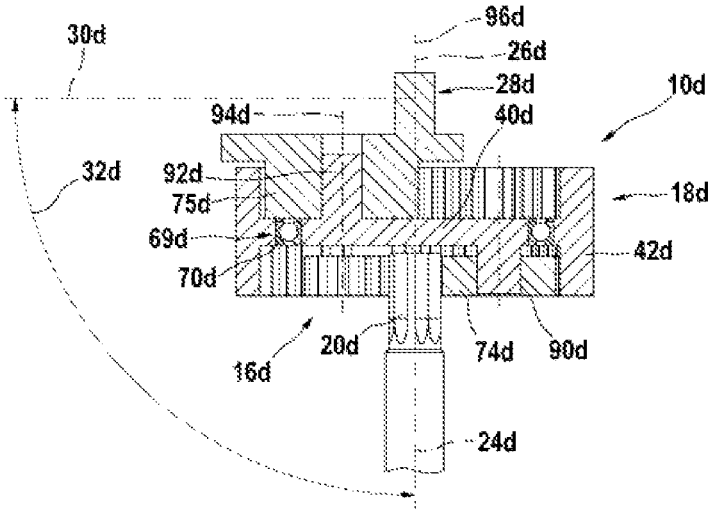
FIG. 7 shows a section through the drill hammer and chipping hammer device along the line VII-VII in FIG. 6.
Figure 8:
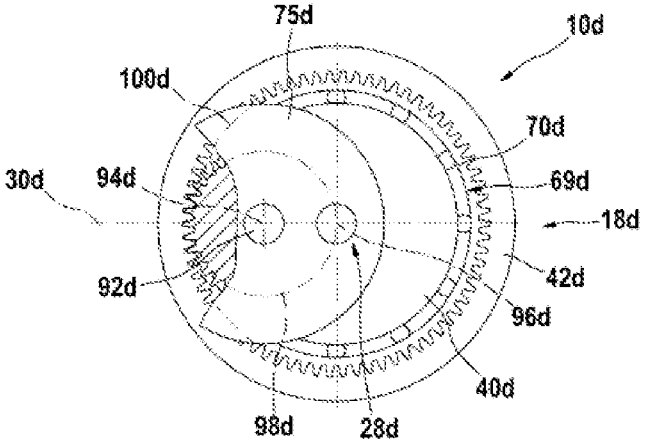
FIG. 8 shows a view of the drill hammer and chipping hammer device from FIG. 5 from above with a part section.

FIG. 5 shows a drill hammer and chipping hammer device of a drill hammer and chipping hammer, with a gear unit 12*d* which has a planetary gear 16*d*. The planetary gear 16*d* has an input element 20*d* which is formed by a sun wheel and the axis of rotation 24*d* of which is arranged coaxially to an axis of rotation 26*d* of a drive unit or a drive element 28*d* of the drive unit of a hammer percussion mechanism 10*d*. The planetary gear 16*d* has a rotatably mounted planet carrier 40*d*, on which three planets 74*d* are mounted rotatably on a side facing the sun wheel. The planets 74*d* mesh inwardly in the radial direction with the sun wheel and outwardly in the radial direction with a ring wheel 42*d*, fastened fixedly in terms of rotation in a housing, not illustrated in any more detail, of the planetary gear 16*d*.

The planet carrier 40*d* of the planetary gear 16*d* has a driven element 92*d* on a side facing away from the sun wheel. The driven element 92*d* is arranged eccentrically to the axis of rotation 24*d*. The driven element 92*d* is formed by a bolt formed in one piece with the planet carrier 40*d*. A planet 75*d* of the planetary gear 16*d* is mounted rotatably on the driven element 92*d* and meshes outwardly in the radial direction with the ring wheel 42*d*. The drive element 28*d* is arranged on the planet 75*d* on a side facing away from the planet carrier 40*d*.

The drive element 28*d* is arranged eccentrically to an axis of rotation 94*d* of the planet 75*d* about which the planet 75*d* is mounted rotatably on the driven element 92*d*. During operation, the planet 75*d* on which the drive element 28*d* is arranged is driven with a superposed rotational movement, so that the drive element 28*d* executes a linear movement along a beating axis 30*d*. The drive element 28*d* has a longitudinal axis 96*d* which runs through a reference circle 98*d* of the planet 74*d* and parallel to the axis of rotation 94*d* of the planet 75*d*. The reference circle 98*d* has a diameter which is half as large as a reference circle diameter of a reference circle 100*d* of the ring wheel 42*d* in which the planet 75*d* can roll. By means of the single ring wheel 42*d*, in which both the planets 74*d* and the planet 75*d* mesh, an especially space-saving construction can be achieved. Basically, however, two separate ring wheels could also be provided.

To pick up a torque for driving a hammer tube in rotation, the planet carrier 40*d* could be connected to a gear wheel or a gear wheel could be integrally formed onto the planet carrier 40*d*. The planet carrier 40*d* is mounted rotatably in the ring wheel 42*d* of the planetary gear 16*d* by means of a bearing connection 69*d* formed by a rolling bearing 70*d*. In order to ensure a lockup function, the ring wheel 42*d* could be mounted in the housing of the drill hammer and chipping hammer via a lockup clutch, and/or a lockup clutch could be arranged between the planet carrier 40*d* and the hammer tube.

The invention claimed is:

1. A hammer device comprising:

a hammer percussion mechanism that includes a drive unit; and a planetary gear unit that is configured to transmit a drive torque from a motor to the hammer percussion mechanism, and that includes:

a first planetary gear stage that has at least one planetary gear; and a second planetary gear stage that is driven by the first planetary gear stage, and that has an eccentric drive element for driving the drive unit.

2. The hammer device as claimed in claim 1, wherein the first planetary gear stage further has an input element that is configured to drive the at least one planetary gear, the axis of rotation of which is arranged at least substantially coaxially to an axis of rotation of the drive element.

3. The hammer device as claimed in claim 1, wherein the drive element is configured to drive the drive unit of the hammer percussion mechanism, or is configured to drive a further planetary gear stage that is configured to drive the hammer percussion mechanism.

4. The hammer device as claimed in claim 1, wherein an axis of rotation of the first planetary gear stage and a beating axis of the hammer percussion mechanism form an angle unequal to zero.

5. The hammer device as claimed in claim 1, wherein:

the hammer percussion mechanism further has a piston and a beater drivable by the piston via a gas cushion; and the eccentric drive element is configured to drive the piston.

6. The hammer device as claimed in claim 1, wherein the second planetary gear stage includes at least one gear element that is formed in one piece with the drive element.

7. The hammer device as claimed in claim 1, further comprising at least one lockup clutch.

8. The hammer device as claimed in claim 7, wherein:

the hammer device further includes a housing;

the planetary gear unit is mounted in the housing, and further includes a ring wheel and a planet carrier; and the lockup clutch is arranged in a region of engagement radially between at least one of (i) the planet carrier and the housing, and (ii) the ring wheel and the housing.

9. The hammer device as claimed in claim 1, wherein the planetary gear unit further has at least one sealing member which is configured and arranged to seal off an inner space defined by the planetary gear unit.

10. The hammer device as claimed in claim 1, wherein:

the planetary gear unit further has a ring wheel and a planet carrier; and the ring wheel and the planet carrier are connected via a bearing connection.

11. The hammer device as claimed in claim 1, wherein the second stage of the planetary gear unit, on which the drive element is arranged, is driven, in at least one operating mode, with a superposed rotational movement, so that the drive element executes a linear movement along a beating axis of the hammer percussion mechanism.

12. The hammer device as claimed in claim 11, wherein:

the second planetary gear stage further includes a second planetary gear; and the drive element of the drive unit is arranged on the second planetary gear.

13. The hammer device as claimed in claim 1, wherein the eccentric drive element of the second planetary gear stage is configured to drive the drive unit of the hammer percussion mechanism in a reciprocating motion.

14. A hammer comprising:

a motor; and a hammer device including:

a hammer percussion mechanism that has a drive unit; and a planetary gear unit that is configured to transmit a drive torque from the motor to the hammer percussion mechanism, and that includes:

a first planetary gear stage with at least one planetary gear; and a second planetary gear stage that is driven by the first planetary gear stage, and that has:

at least one further planetary gear; and an eccentric drive element arranged on the at least one further planetary gear, and configured to drive the drive unit.

15. The hammer of claim 14, wherein the eccentric drive element of the second planetary gear stage is configured to drive the drive unit of the hammer percussion mechanism in a reciprocating motion.

16. A hammer device comprising:

a hammer percussion mechanism that includes a drive unit; and a planetary gear unit that is configured to transmit a drive torque from a motor to the hammer percussion mechanism, and that includes:

a first planetary gear stage that has:

an input element configured to rotate about a first axis of rotation; and at least one planetary gear that is driven by the input element; and a second planetary gear stage that is driven by the first planetary gear stage, and that has an eccentric drive element for driving the drive unit, the eccentric drive element configured to eccentrically rotate about a second axis of rotation that is at least substantially coaxial to the first axis of rotation.

17. The hammer device of claim 16, wherein the eccentric drive element of the second planetary gear stage is configured to drive the drive unit of the hammer percussion mechanism in a reciprocating motion.

18. The hammer device as claimed in claim 1, wherein:

the second planetary gear stage further has a ring wheel; and the eccentric element is integral with the ring wheel.

19. The hammer device as claimed in claim 14, wherein:

the second planetary gear stage further has a ring wheel; and the eccentric element is integral with the ring wheel.

20. The hammer device as claimed in claim 16, wherein:

the second planetary gear stage further has a ring wheel; and the eccentric element is integral with the ring wheel.

* * * * *